US011796232B2

(12) United States Patent
Roady et al.

(10) Patent No.: US 11,796,232 B2
(45) Date of Patent: Oct. 24, 2023

(54) CONICAL REFRIGERANT COIL

(71) Applicant: GREEN AIR, INC., Ashland, VA (US)

(72) Inventors: Nathaniel S. Roady, Montpelier, VA (US); Evan Paul Sachdeva, Richmond, VA (US)

(73) Assignee: Green Air, Inc., Ashland, VA (US)

( * ) Notice: Subject to any disclaimer, the term of this patent is extended or adjusted under 35 U.S.C. 154(b) by 60 days.

(21) Appl. No.: 17/492,292

(22) Filed: Oct. 1, 2021

(65) Prior Publication Data

US 2022/0107120 A1 Apr. 7, 2022

Related U.S. Application Data

(60) Provisional application No. 63/086,806, filed on Oct. 2, 2020.

(51) Int. Cl.
*F25B 39/04* (2006.01)

(52) U.S. Cl.
CPC ..... *F25B 39/04* (2013.01)

(58) Field of Classification Search
CPC ..... F25B 39/04; F25B 39/02; F25B 2339/02; F24F 1/0067
See application file for complete search history.

(56) References Cited

U.S. PATENT DOCUMENTS 4,451,960 A * 6/1984 Molitor ..... B21D 53/027 228/183
4,967,830 A 11/1990 Eubank et al.
5,782,290 A 7/1998 Cook
9,447,997 B2 9/2016 Kyle et al.
2008/0000617 A1 1/2008 Cortina-Cordero
2008/0196860 A1 8/2008 Petlach
2012/0011873 A1 1/2012 Blackstone
2012/0318017 A1* 12/2012 Cheng ..... F28D 7/0066 62/616
2016/0084266 A1 3/2016 Showole
2018/0209694 A1 7/2018 Gordon
2018/0313553 A1* 11/2018 Ma ..... F24F 3/14
2020/0132347 A1* 4/2020 Sun ..... F25B 39/028
2020/0309393 A1* 10/2020 Bhosale ..... F24F 13/20

FOREIGN PATENT DOCUMENTS

CN 1815095 A 8/2006

OTHER PUBLICATIONS

Pdf attached is NPL referecne Global research & development journal vol. 2 Issue 11 Oct. 11, 2017 ISSN: 2455-5703 (Year: 2017).*
Pdf is NPL referecne global research and development journal vol. 2 issue 11 Oct. 2017 ISSN: 2455-5703 (2017) (Year: 2017).*
(Continued)

*Primary Examiner* — Len Tran
*Assistant Examiner* — Kamran Tavakoldavani
(74) *Attorney, Agent, or Firm* — Thedford I. Hitaffer; Hitaffer & Hitaffer, PLLC

(57) ABSTRACT

A conical refrigerant coil comprises a plurality of pipes, each pipe arranged in a conical spiral and each pipe comprising a plurality of loops. At least some of the loops of each pipe of the plurality of pipes are arranged alternatingly along at least a portion of a length of the coil.

18 Claims, 16 Drawing Sheets

(56) References Cited

OTHER PUBLICATIONS

Waghmare et al., Comparative Numerical Analysis of Straight and Conical Coil Heat Exchanger, GRD Journals—Global Research and Development Journal for Engineering, vol. 2, Issue 11, Oct. 2017, 9 pages.

Abdelghany et al., Enhancement the Thermal performance of a Shell and Coil Heat exchanger with different Coil Geometries: Comparative experimental investigation, Engineering Research Journal, vol. 1, No. 43 Jan. 2020, pp. 57-65, 9 pages.

Webpage for monometal fin tube heat exchanger from Ningbo Winroad Refrigeration Equipment Co., Ltd., available at http://finnedtube.en.hisupplier.com/product-444857-monometal-fin-tube-heat-exchanger.html, last accessed Oct. 1, 2021, 3 pages.

* cited by examiner

CONICAL REFRIGERANT COIL

CROSS-REFERENCE TO RELATED APPLICATIONS

This application claims priority to U.S. Provisional Application Ser. No. 63/086,806, filed Oct. 2, 2020, the contents of which are incorporated herein by reference in its entirety.

FIELD OF THE INVENTION

The present technology relates generally to heating, ventilation, and air conditioning (HVAC) system.

BACKGROUND

Heating, ventilation, and air conditioning (HVAC) systems heat and/or cool air within a house or other enclosed space by drawing air through return ducts into an air handler where the air is heated or cooled and then forced back into the space through supply ducts. The air handler typically includes a refrigerant coil through which a refrigerant is pumped. Air flowing across the refrigerant coil cools the air. The air handler also typically includes one or more heating elements, which may be one or more resistive wire coils in an electric system or one or more burners in a gas or oil system. Air flowing across the heating elements heats the air.

Air handlers typically have a square or rectangular cross-sectional shape. Such a shape causes turbulence in the air flowing through the air handler, which reduces the efficiency of the system.

Conventional air handlers typically have an A-frame refrigerant coil, in which a copper or aluminum pipe carrying the refrigerant is arranged in many dozens or even hundreds of relatively short linear portions. Each pair of adjacent linear portions is joined by a U-joint. Each U-joint is either formed by bending the pipe or by soldering a small U-shaped section of pipe to the adjacent ends of the adjacent linear sections of pipe (typically half are formed by bending and half are formed by soldering). As a result, a conventional A-frame coil has many dozens or even hundreds of solder joints. Such solder joints are common failure points. Additionally, the zig-zag path of the refrigerant due to the many dozens or even hundreds of U-turns in the coil increases the backpressure, resulting in increased power consumption and strain on the compressor which will likely shorten the life of the compressor.

BRIEF SUMMARY OF THE DISCLOSURE

In one embodiment of the invention, a conical refrigerant coil comprises a plurality of pipes, each pipe arranged in a conical spiral and each pipe comprising a plurality of loops. At least some of the loops of each pipe of the plurality of pipes are arranged alternatingly along at least a portion of a length of the coil.

Each pipe of the plurality of pipes may comprise a plurality of heat sink structures projecting therefrom. The plurality of heat sink structures may comprise a plurality of wires or a plurality of fins.

The plurality of pipes may be a first plurality of pipes, and the coil may further comprise a second plurality of pipes. Each of the second plurality of pipes are arranged in a conical spiral and each of the second plurality of pipes comprising a plurality of loops. At least some of the loops of each pipe of the second plurality of pipes are arranged alternatingly along at least a portion of a length of the coil.

The second plurality of pipes is positioned at least partially within an interior space created by the first plurality of pipes. Each pipe of the second plurality of pipes may comprise a plurality of heat sink structures projecting therefrom. The plurality of heat sink structures projecting from each pipe of the second plurality of pipes may comprise a plurality of wires or a plurality of fins.

The coil may further comprise a supply junction and a return junction. The supply junction comprises a proximal end adapted to be connected to a refrigerant supply line and a distal end having a plurality of connection points. Each connection point of the distal end of the supply junction is connected to a proximal end of a corresponding pipe. The return junction comprises a proximal end having a plurality of connection points and a distal end adapted to be connected to a refrigerant return line. Each connection point of the proximal end of the return junction is connected to a distal end of a corresponding pipe. The supply junction is adapted to receive a refrigerant via the refrigerant supply line and distribute the refrigerant among the plurality of pipes.

In alternative embodiments of the invention, an air handler comprises a housing, a conical refrigerant coil as described above within the housing, and a fan within the housing adapted to blow or draw air across the conical refrigerant coil.

The air handler may further comprise a plug positioned at a narrow end of the conical refrigerant coil to reduce or eliminate air flow through the narrow end of the conical refrigerant coil.

In alternative embodiments of the invention, a conical refrigerant coil comprises a first pipe arranged in a conical spiral and comprising a plurality of loops and a second pipe arranged in a conical spiral and comprising a plurality of loops. Two or more of the loops of the first pipe are arranged alternatingly with two or more loops of the second pipe along at least a portion of a length of the coil.

The first and second pipe each may comprise a plurality of heat sink structures projecting therefrom. The plurality of heat sink structures may comprise a plurality of wires or a plurality of fins.

The coil may further comprise a third pipe arranged in a conical spiral and comprising a plurality of loops, and a fourth pipe arranged in a conical spiral and comprising a plurality of loops. Two or more of the loops of the third pipe are arranged alternatingly with two or more loops of the fourth pipe along at least a portion of a length of the coil. The third and fourth pipes are positioned at least partially within an interior space created by the first and second pipes.

The third and fourth pipe each may comprise a plurality of heat sink structures projecting therefrom. The plurality of heat sink structures projecting from the third and fourth pipes may comprise a plurality of wires or a plurality of fins.

The coil may further comprise a supply junction and a return junction. The supply junction comprises a proximal end adapted to be connected to a refrigerant supply line and a distal end having at least two connection points. Each connection point of the distal end of the supply junction is connected to a proximal end of a corresponding pipe. The return junction comprises a proximal end having at least two connection points and a distal end adapted to be connected to a refrigerant return line. Each connection point of the proximal end of the return junction is connected to a distal end of a corresponding pipe. The supply junction is adapted to receive a refrigerant via the refrigerant supply line and distribute the refrigerant among the pipes.

BRIEF DESCRIPTION OF THE SEVERAL VIEWS OF THE DRAWINGS

Reference will now be made to the accompanying drawings, which are not necessarily drawn to scale. The following detailed description of the disclosure will be better understood when read in conjunction with the appended drawings. It should be understood, however, that the disclosure is not limited to the precise arrangements and instrumentalities shown. In the drawings.

DETAILED DESCRIPTION OF THE DISCLOSURE

Figure 1:
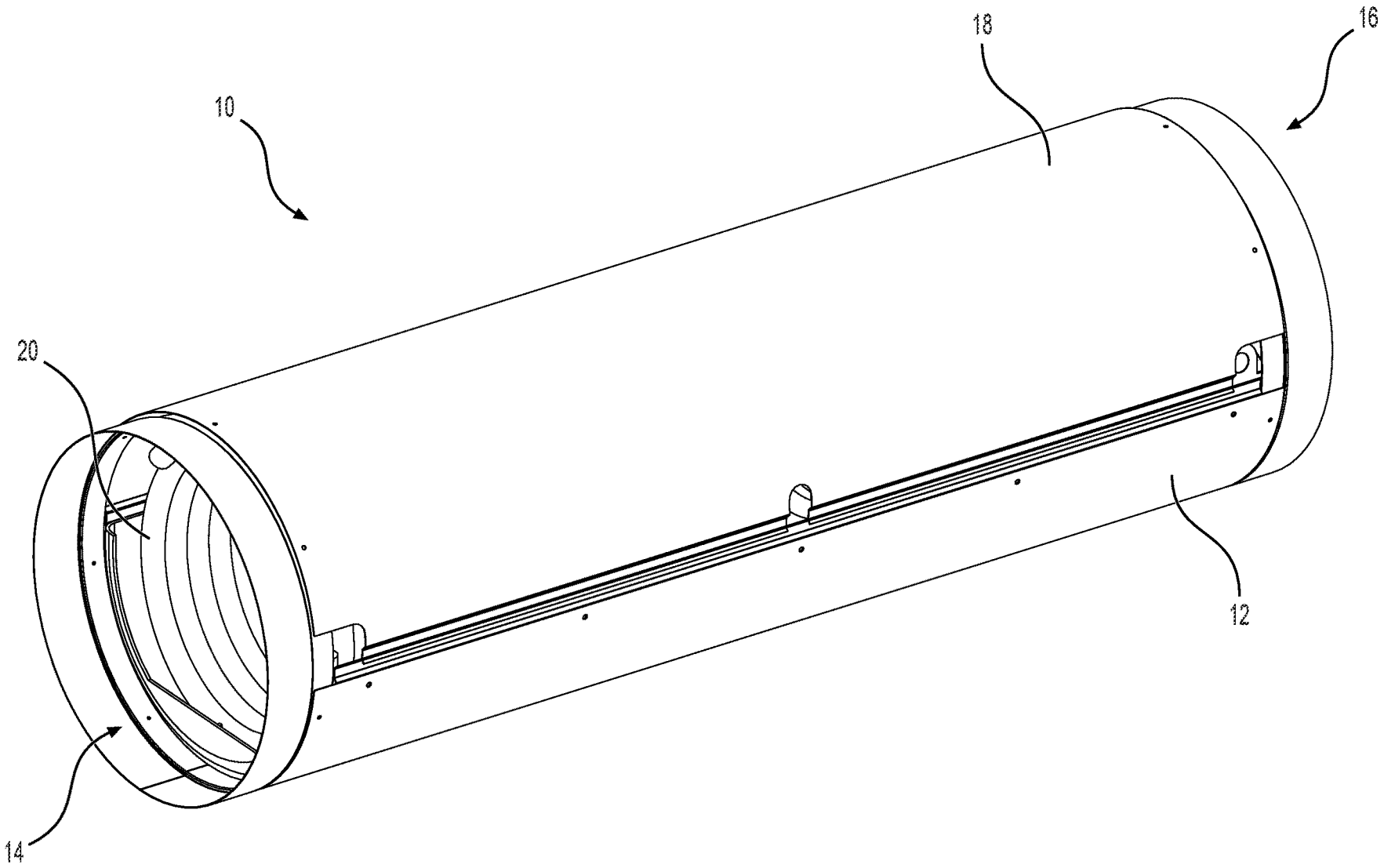
FIG. 1 is a top left perspective view of a cylindrical air handler, in accordance with embodiments of the present invention.

Certain terminology is used in the following description for convenience only and is not limiting. The words "lower," "bottom," "upper," and "top" designate directions in the drawings to which reference is made. The words "inwardly," "outwardly," "upwardly" and "downwardly" refer to directions toward and away from, respectively, the geometric center of the device, and designated parts thereof, in accordance with the present disclosure. Unless specifically set forth herein, the terms "a," "an" and "the" are not limited to one element, but instead should be read as meaning "at least one." The terminology includes the words noted above, derivatives thereof and words of similar import.

Embodiments of the invention are directed to a cylindrical air handler and a conical refrigerant coil for use in such a cylindrical air handler. Such a cylindrical air handler reduces turbulence of the air flowing through the air handler, and therefore has increased efficiency. The conical refrigerant coil provides an effective mechanism for cooling the air in such a cylindrical air handler. Embodiments of the invention are also directed to a method of cooling air using a cylindrical air handler having a conical refrigerant coil. The term refrigerant coil as used herein refers to one or more pipes through which a refrigerant (such as R22 or R410A) flows and which are arranged such that a fluid (e.g., air) can flow across/through the pipes to facilitate heat transfer. Such refrigerant coils are used in central air conditioning systems, among other uses. In the specific embodiments of the invention described herein, the refrigerant coil is an evaporator coil in an air handler of a central air conditioning system. However, refrigerant coils of embodiments of the invention are not necessarily limited to evaporator coils or to air conditioning systems.

Referring now to the figures, a cylindrical air handler 10 comprises an outer housing 12 having a generally cylindrical shape. The housing 12 is typically constructed of sheet metal, but may be constructed of any suitable material. The housing 12 typically has a hinged or removable access panel or door 18 to enable the internal components to be accessed for servicing. The access panel 18 may be hingedly affixed to the housing 12. The access panel 18 may be structured such that the access panel 18 can be hingedly affixed to the housing 12 via either opposing side of the access panel 18, thereby enabling easy access to the inner components regardless of mounting position of the air handler (e.g., air flow left to right or right to left).

The air handler 10 has a first open end 14 and a second open end 16. The return duct(s) (not illustrated) may be connected to the air handler 10 via the first open end 14 and the supply duct(s) (not illustrated) may be connected to the air handler 10 via the second open end 16 (or vice versa if the refrigerant coil is reversed). Air is drawn into the cylindrical air handler 10 via a conventional inline duct fan 26 rotated by an electric motor (not visible). Any suitable type and size of fan and any suitable type and size of motor may be used. The fan 26 is illustrated as downstream of the refrigerant coil 20, however the fan may optionally be located in other positions. The air that is drawn into the cylindrical air handler 10 passes across the novel conical refrigerant coil 20. (The refrigerant coil 20 is termed a conical coil as its overall shape is conical.)

The air handler 10 may also comprise a heating element 24, which comprises four circular resistive wire coils in the illustrated embodiment (fewer or more resistive wire coils may be used, or a different type of heating element may be used). Such a use of heating elements within an air handler is conventionally known. The air handler will typically comprise a control module 22 comprising a variety of electrical and electronic components, as is conventionally known.

When air is cooled by flowing over refrigerant coils, moisture in the air condenses and must be drained away. Conventional air handlers typically have a drain pan at the bottom of the housing to catch dripping condensation, and a drain tube to carry the condensation from the drain pan to the exterior of the conditioned space or to a plumbing drain.

Figure 2:
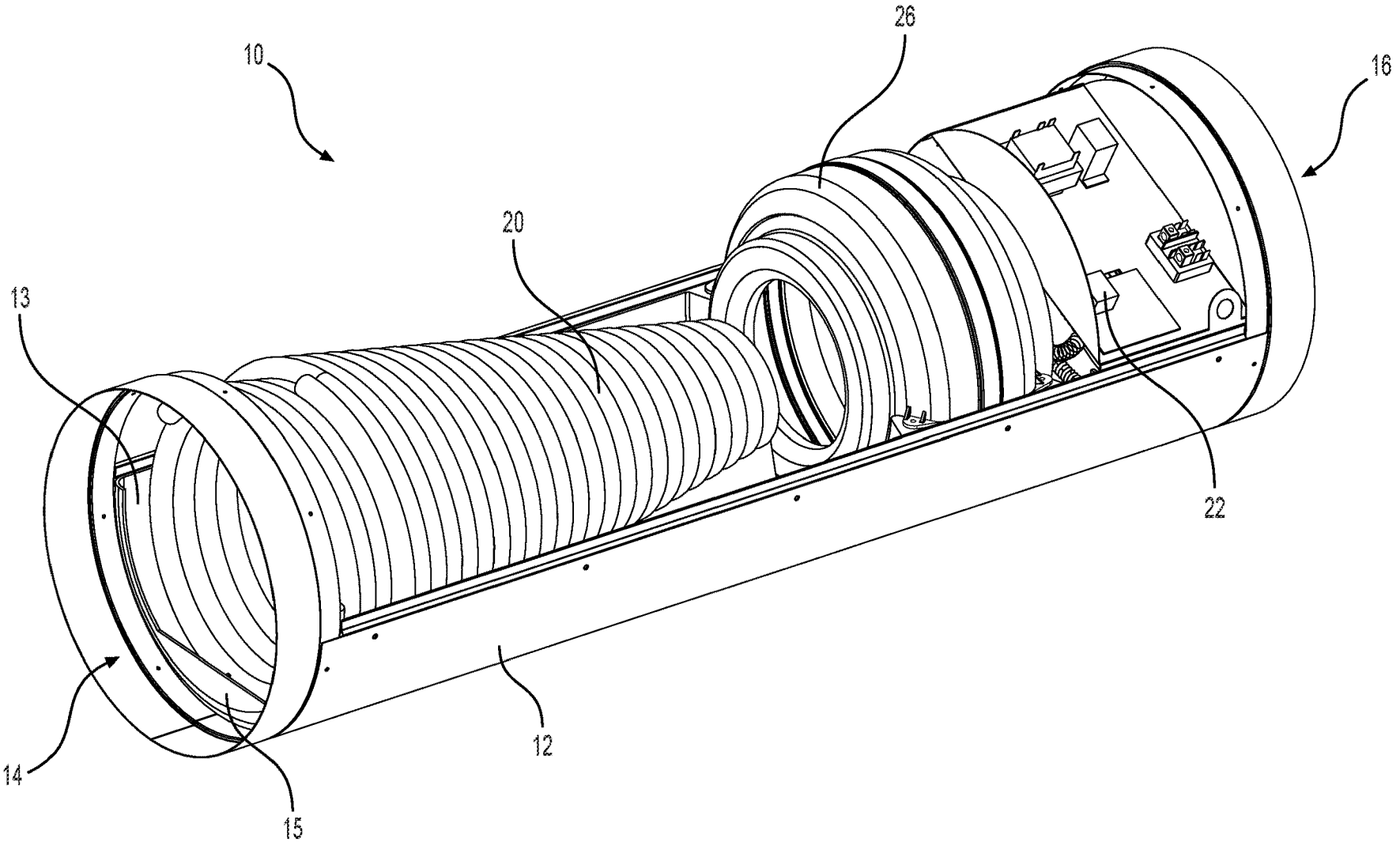
FIG. 2 is a top left perspective view of the cylindrical air handler of FIG. 1, with a portion of the housing removed.
Figure 3:
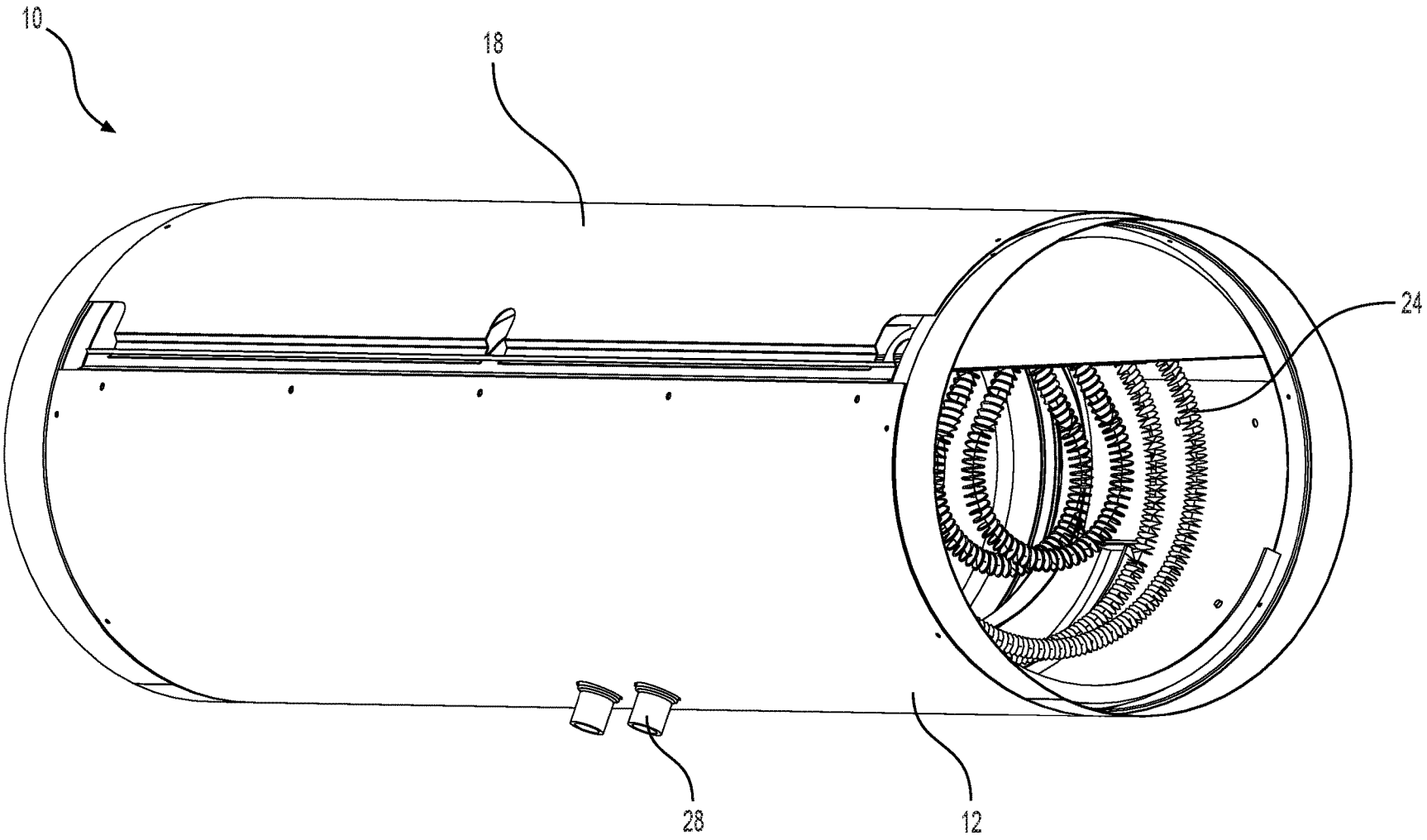
FIG. 3 is a bottom right perspective view of the cylindrical air handler of FIG. 1
Figure 4:
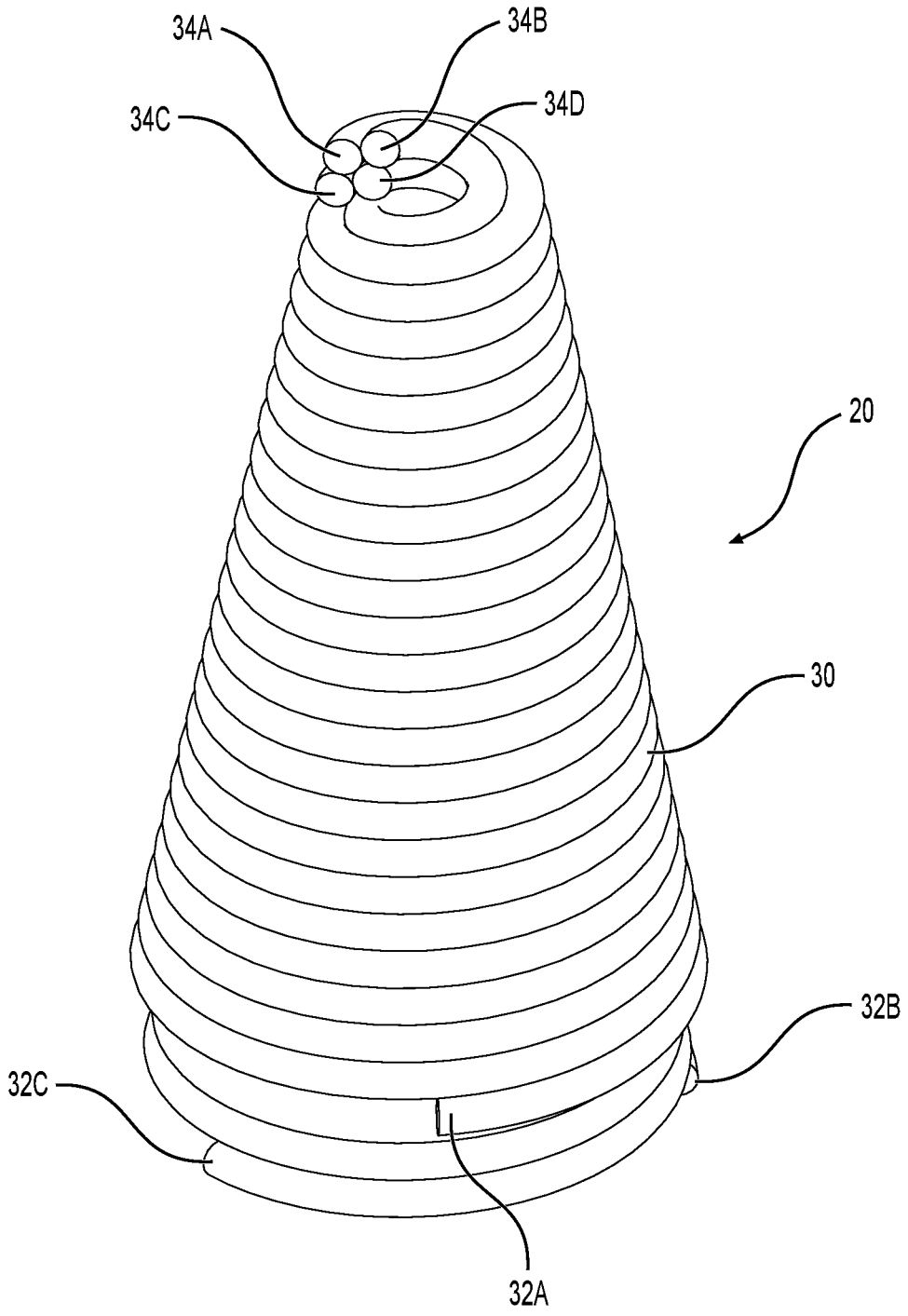
FIG. 4 is a perspective view of a conical refrigerant coil removed from the cylindrical air handler of FIG. 1 for visibility.
Figure 5:
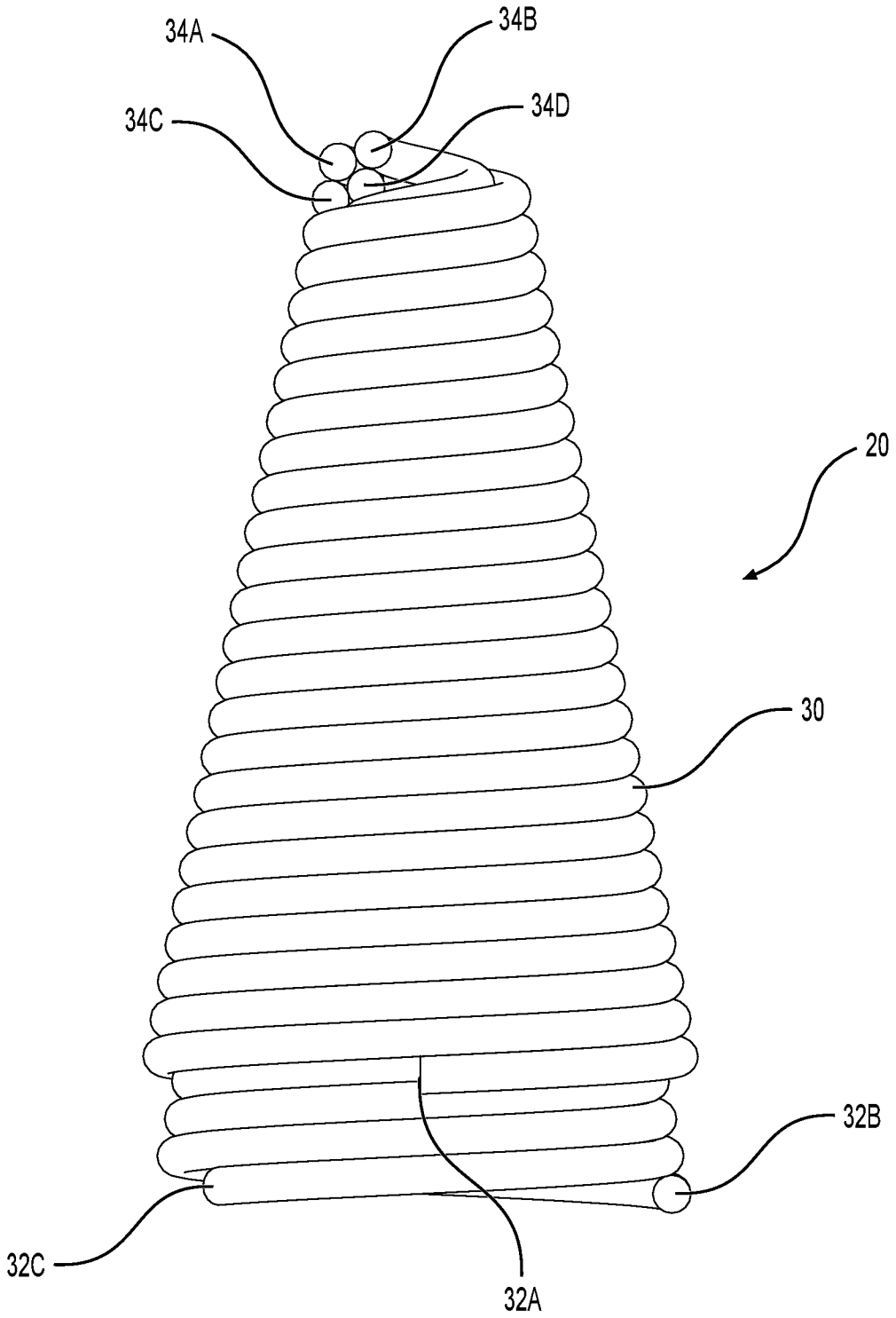
FIG. 5 is a side view of the conical refrigerant coil of FIG. 4.
Figure 6:
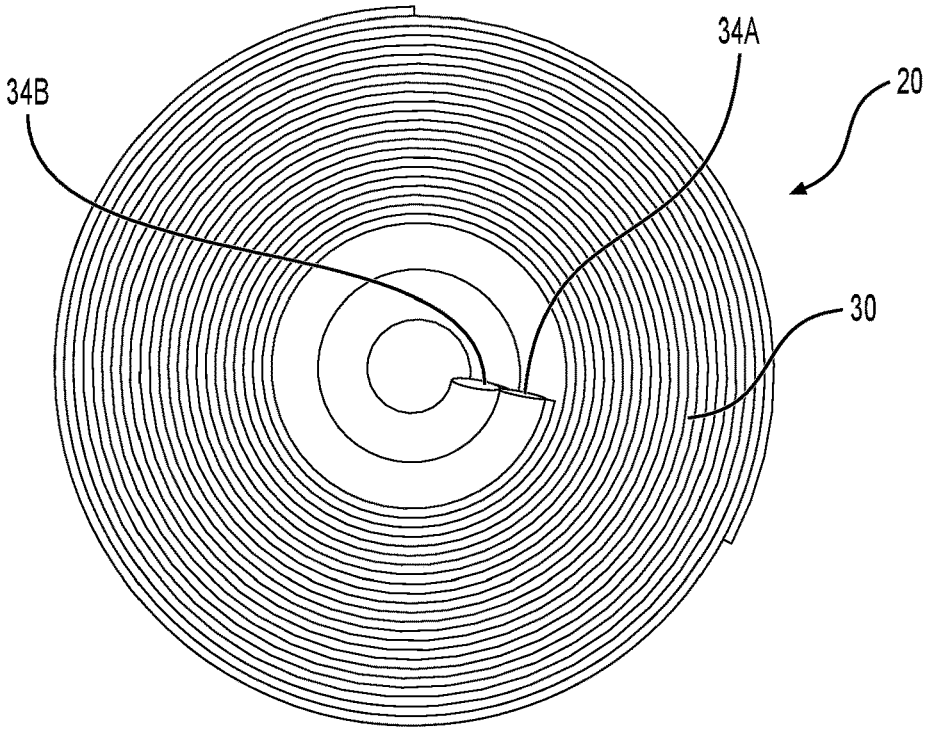
FIG. 6 is a top view of the conical refrigerant coil of FIG. 4.
Figure 7:
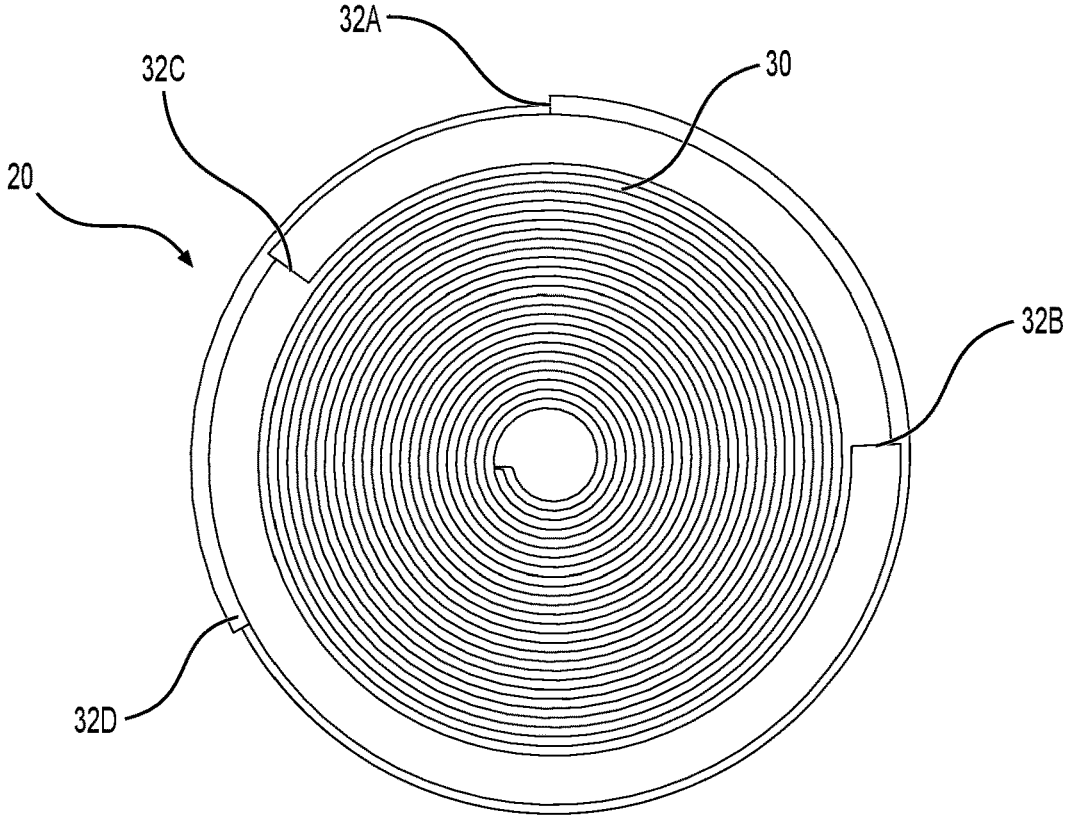
FIG. 7 is a bottom view of the conical refrigerant coil of FIG. 4.

Such conventional drain pans are typically formed from injection-molded plastic as shallow pans. These conventional drain pans are prone to damaging leaks, especially at the corner seams. Because of the cylindrical shape of the housing 12, a semi-cylindrical drain pan 13 can be readily formed (typically by injection-molded plastic) and placed within the housing 12 as seen in FIG. 2. Because of the horizontal orientation of the drain pan 13, it would typically be necessary to mount condensate barriers or dams 15 on opposing ends of the drain pan 13 to prevent the condensate from flowing out of the housing and into the supply and/or return ducts. Insulation is typically installed between the drain pan 13 and the housing 12. One or more drain tubes 28 (a small portion of which is illustrated) would be installed to drain the condensate from the drain pan.

Figure 8:
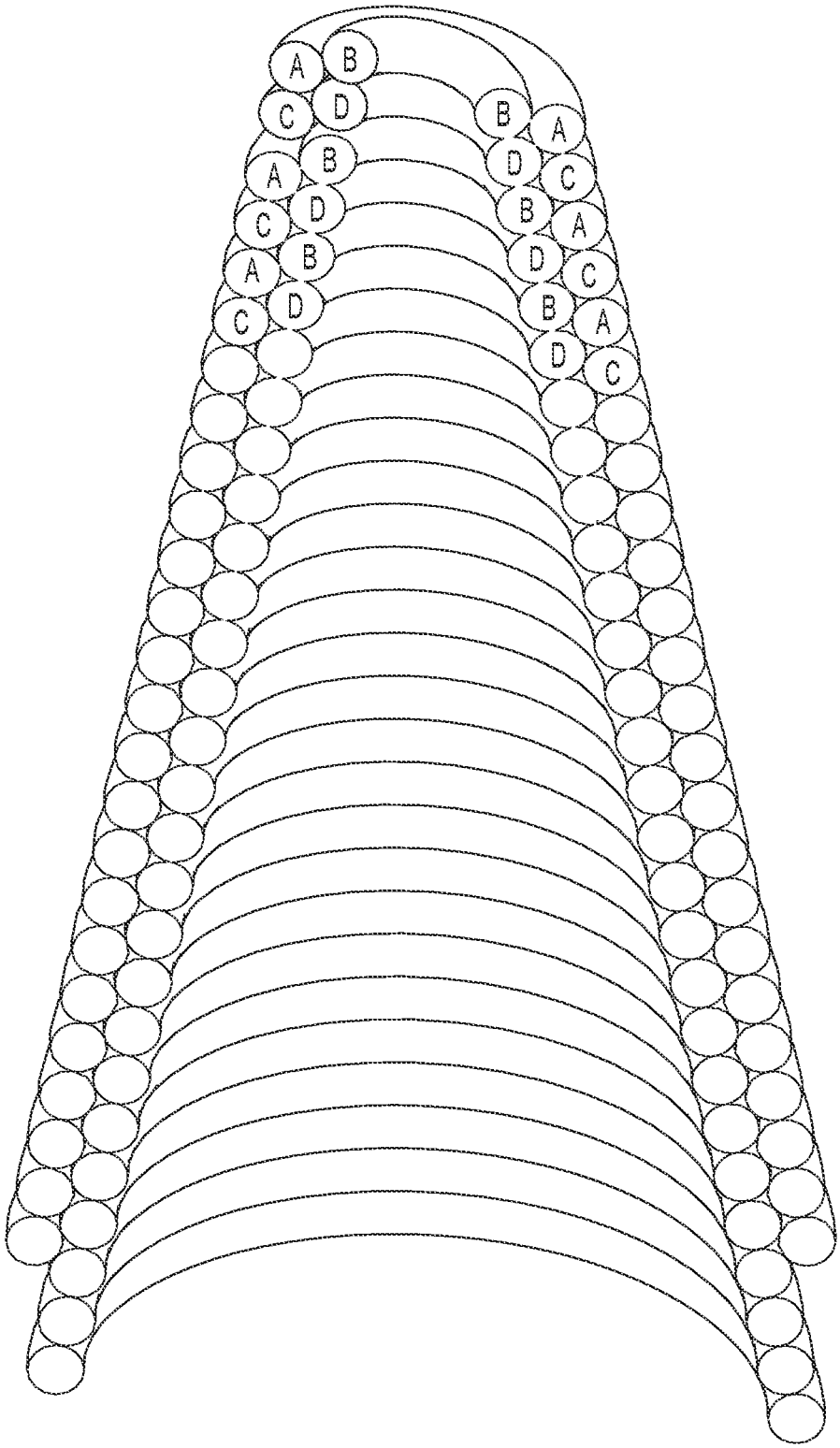
FIG. 8 is a sectional view of the conical refrigerant coil of FIG. 4.

As seen in FIGS. 4-8, the conical refrigerant coil 20 of embodiments of the invention comprises a plurality of coil lines 30 (four coil lines 30 are illustrated in FIGS. 4-7, although fewer or more coil lines may be used). Each coil line 30 has a conical spiral shape and together the four coil lines have a conical spiral shape, in that the coil lines spiral upward and inward to form a refrigerant coil having an overall conical shape as illustrated. Each coil line 30 has a proximal end 32A-D (also termed an input end or a liquid end) and a corresponding distal end 34A-D (also termed an output end or a suction end). As each coil line 30 spirals upward from the proximal end to the distal end, a plurality of loops are formed (a loop comprises a 360 degree segment of coil line). The conical refrigerant coil 20 of FIGS. 4-8 is constructed of two outer coil lines that spiral together, such that the loops of each coil line alternate, and two inner coil lines that spiral together, such that the loops of each coil line alternate. This alternating arrangement can be seen in the section view of FIG. 8, in which the two outer coil lines are labeled A and C and the two inner coil lines are labeled B and D. The two inner coil lines are nested within the two outer coil lines, as best seen in FIG. 8.

The coil lines 30 are typically constructed of aluminum or copper tubing (or any other suitable material), and the tubing may have any suitable diameter depending on the desired cooling capacity of the system. The overall size of each conical refrigerant coil (height and/or diameter) may vary depending on the desired cooling capacity and air handling capacity of the system.

Figure 9:
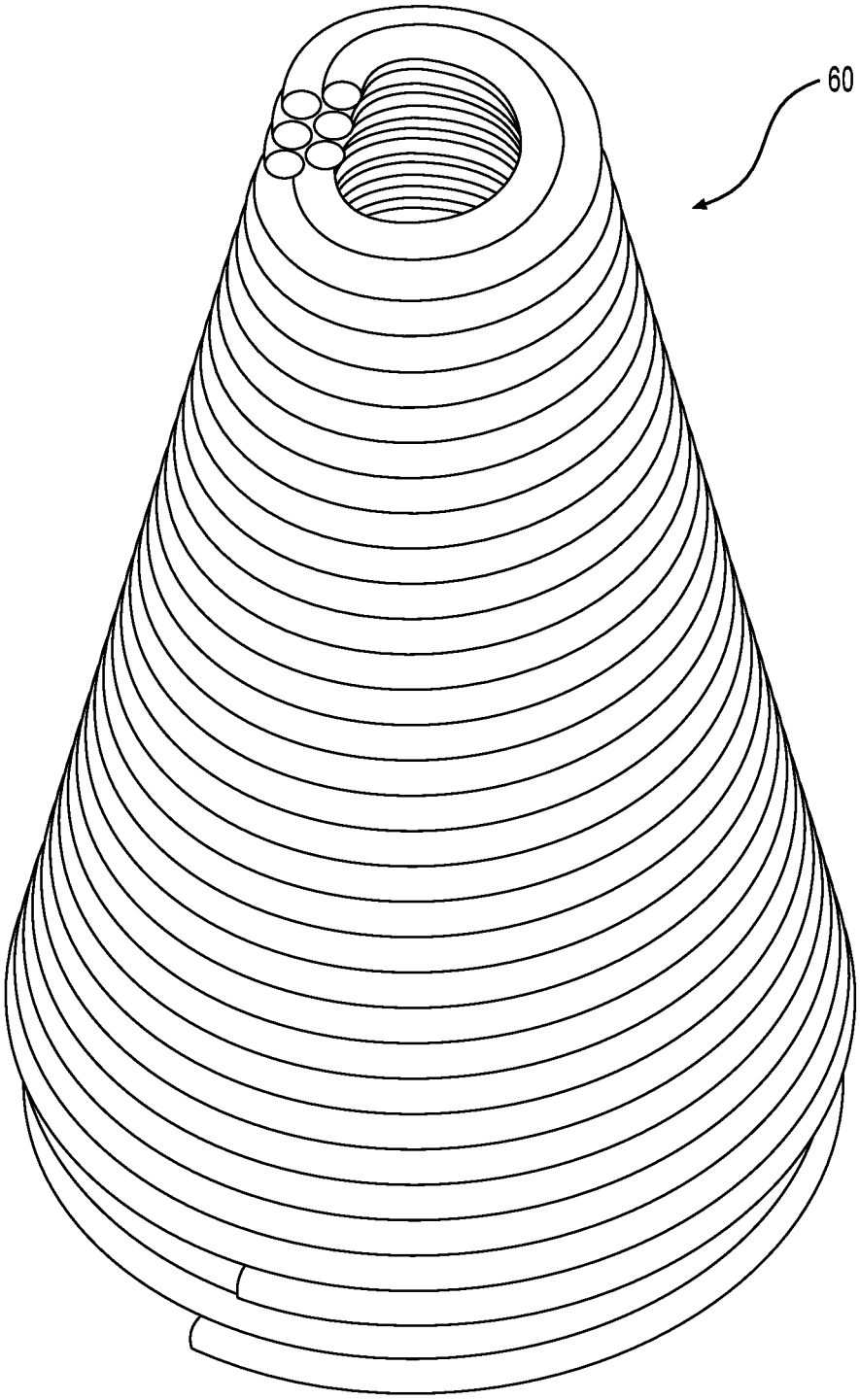
FIG. 9 is a perspective view of a conical refrigerant coil, in accordance with alternative embodiments of the invention.
Figure 10:
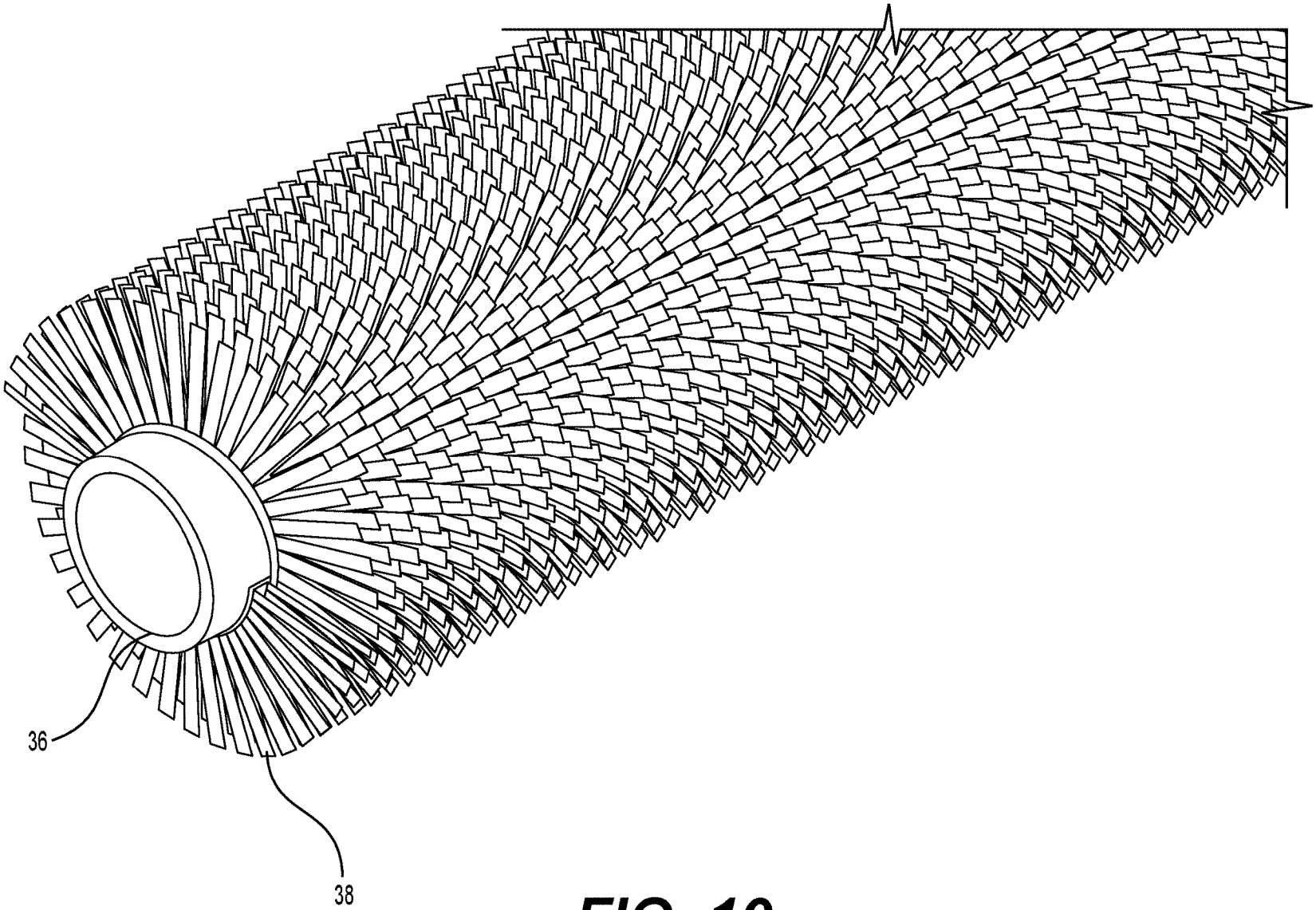
FIG. 10 is a perspective view of a portion of the refrigerant coil of FIG. 4 before being bent into its conical shape.
Figure 11:
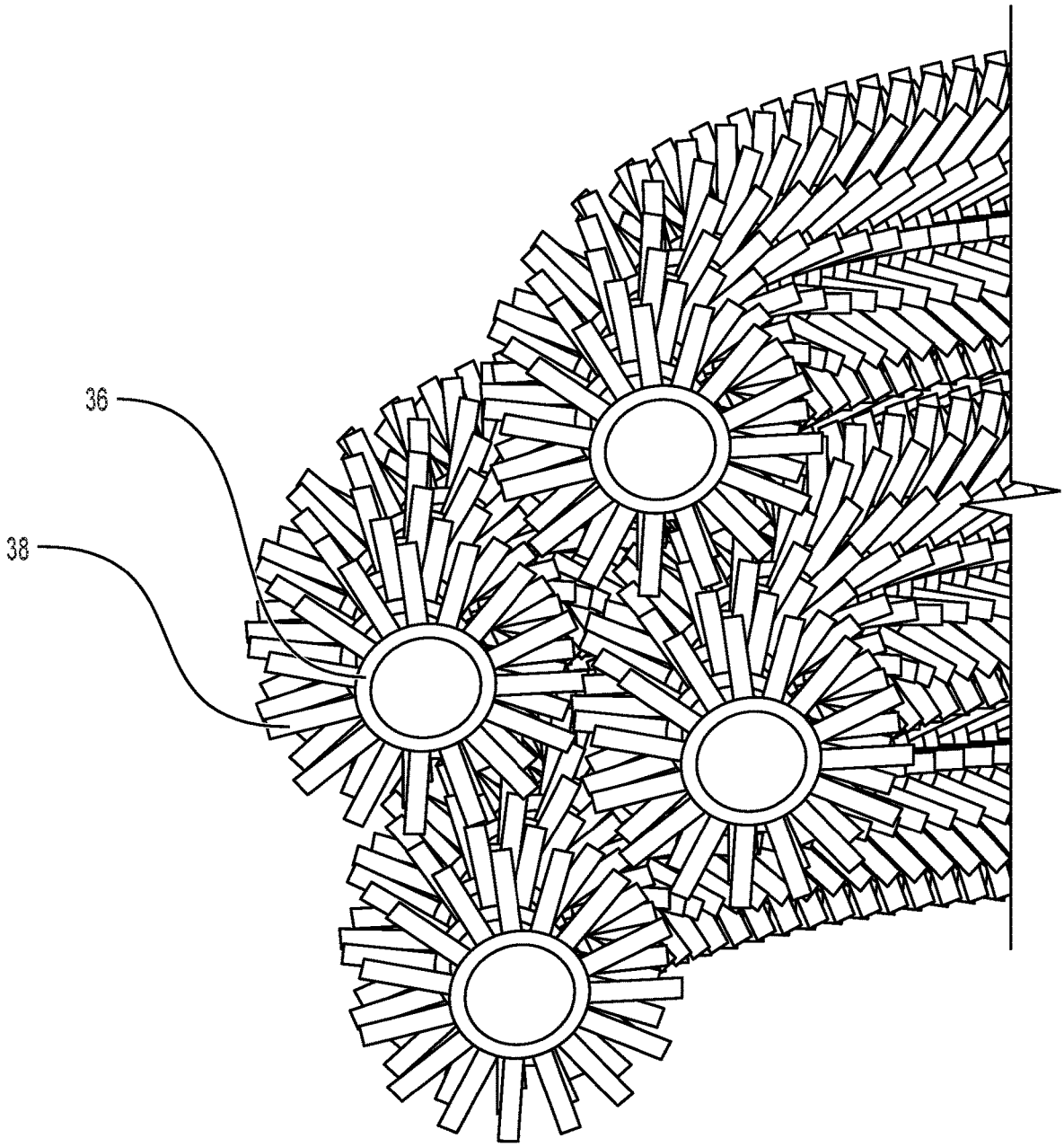
FIG. 11 is a perspective view of a portion of conical refrigerant coil of FIG. 4, showing the details of the cooling fins.

For simplicity, FIGS. 4-8 and FIG. 9 illustrate the coil lines as being simple tubes that are directly adjacent to and touching each other. However, the illustrated coil lines in FIGS. 4-8 and 9 represent a smaller diameter pipe covered by a large number of heat sink structures, such as cooling fins or cooling wires (such cooling fins and cooling wires are conventionally known to be used with refrigerant coils). The heat sink structures may be constructed of aluminum, or any other suitable material. FIG. 10 illustrates a straight section of a coil line (prior to bending into a spiral cone) comprising a pipe 36 and a large number of cooling fins 38 attached to the outer surface thereof. Any suitable size and type of pipe and heat sink structure may be used. For example, the pipe may have an outer diameter of ⅜ inch, and the overall outer diameter of the coil lines when the cooling fins have been attached to the pipe may be ⅞ inch. FIG. 11 illustrates small portions of four coil lines that have been bent into conical spirals, showing the close arrangement of the four different pipes 36 and corresponding cooling fins 38. In real-world implementations of the embodiments of the invention, the heat sink structures would likely be much greater in number and more densely spaced as compared to FIGS. 10 and 11 (the number and spacing of the heat sink structures shown in the figures is simplified for clarity).

The spacing of the coil lines may vary and is selected to provide enough space for the heat sink structures and to enable proper air flow across and between the coil lines. For example, the coil lines may be spaced apart from each other such that some of the distal ends of the cooling fins of one coil line would touch some of the distal ends of the cooling fins of an adjacent coil line. Alternatively, the coil lines may be spaced apart from each other such that some of the distal ends of the cooling fins of one coil line would extend past some of the distal ends of the cooling fins of an adjacent coil line, such that the cooling fins "mesh" to some extent.

Figure 12:
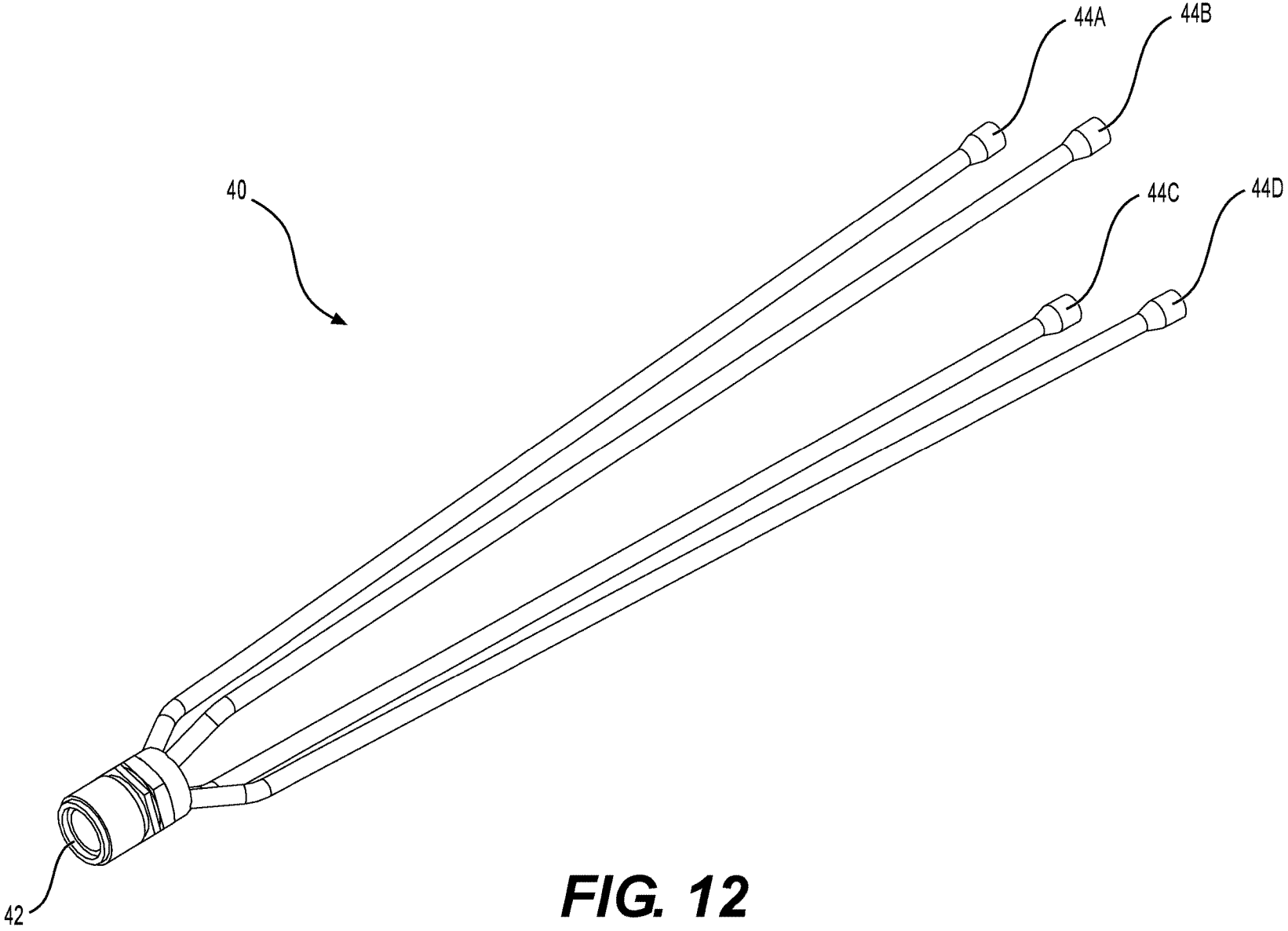
FIG. 12 is a perspective view of liquid line distributor cap of the cylindrical air handler of FIG. 1.

The proximal end 32A-D of each coil line 30 is affixed to and in fluid communication with a refrigerant supply junction, which may also be termed a liquid line distributor cap 40 as seen in FIG. 12. The liquid line distributor cap 40 comprises a single proximal end 42 that is affixed (such as by soldering or any suitable method) to a refrigerant supply line (not illustrated) and a plurality of distal ends 44A-D (the number of distal ends corresponds to the number of coil lines in the conical coil) that are each affixed (such as by soldering or any suitable method) to a corresponding coil line 30 to distribute refrigerant roughly equally to each of the coil lines 30. The liquid line distributor cap 40 is typically constructed of aluminum or copper, or any other suitable material.

Figure 13:
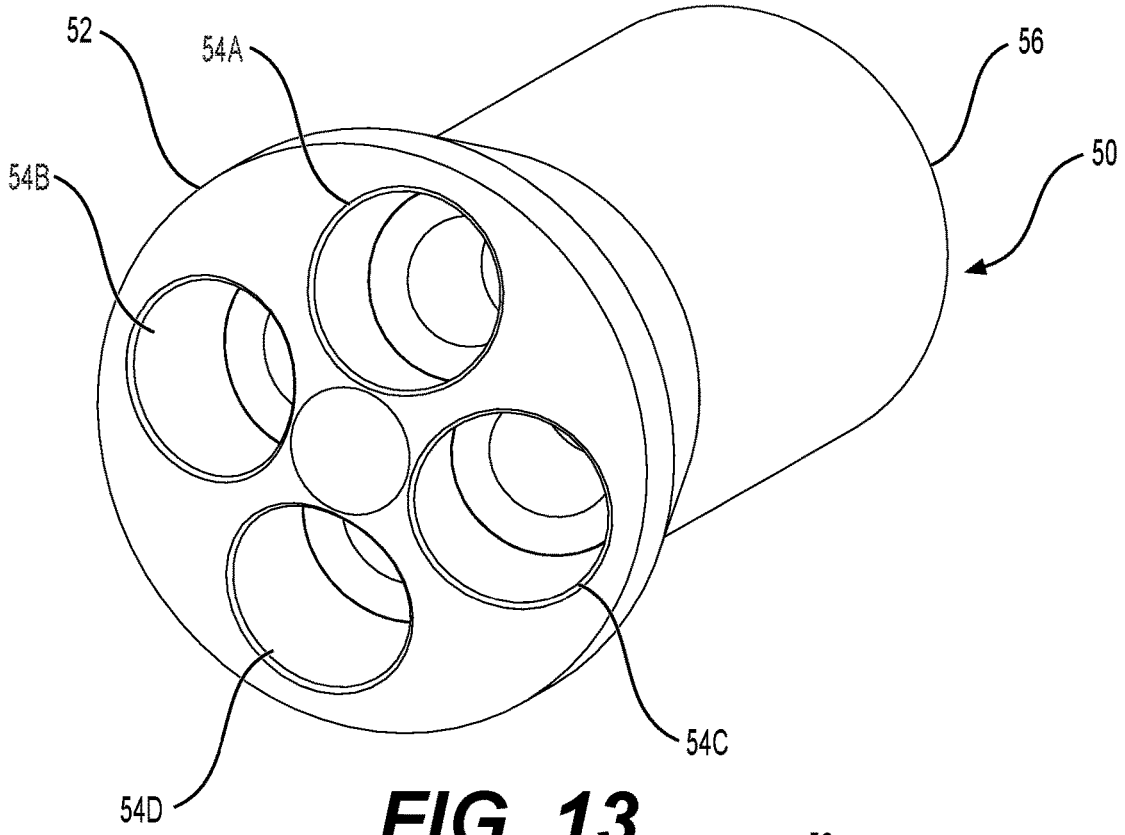
FIG. 13 is a proximal end perspective view of suction line distributor cap of the cylindrical air handler of FIG. 1.
Figure 14:
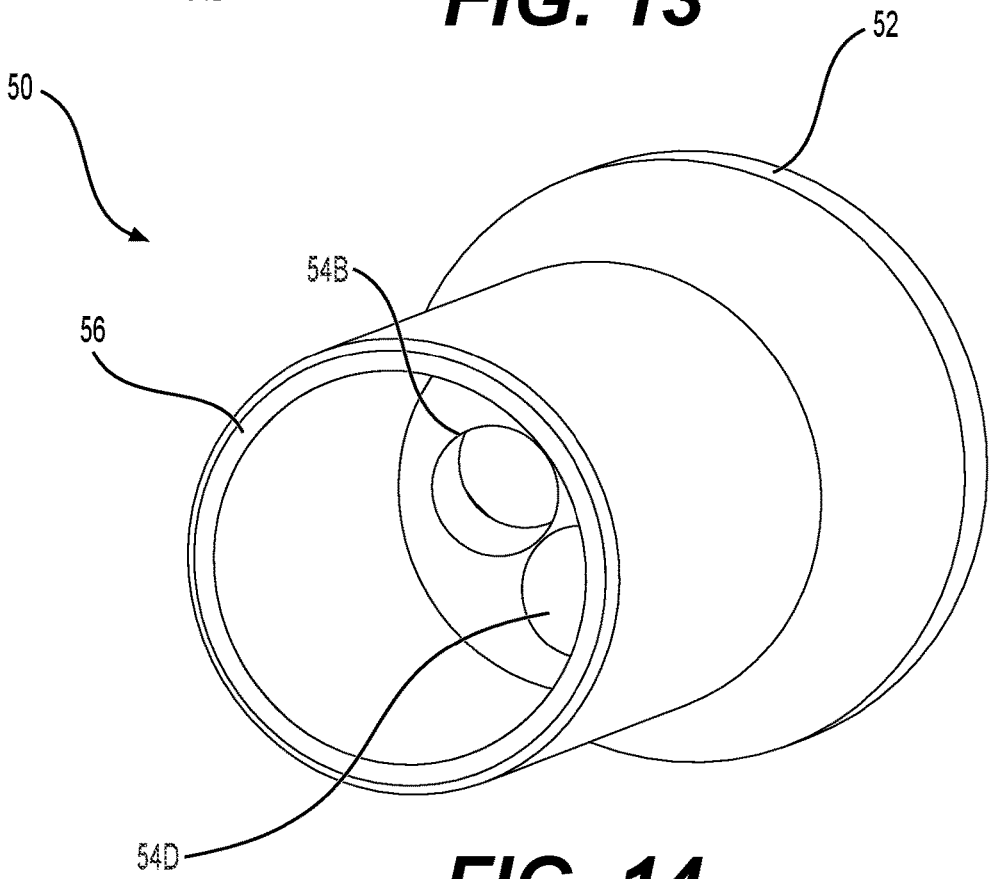
FIG. 14 is a distal end perspective view of suction line distributor cap of the cylindrical air handler of FIG. 1.

The distal end 34A-D of each coil line 30 is affixed to and in fluid communication with a refrigerant return junction, which may also be termed a vacuum line distributor cap 50 as seen in FIG. 13. The vacuum line distributor cap 50 comprises a proximal end 52 having a plurality of connection points 54A-D (the number of connection points corresponds to the number of coil lines in the conical coil) and a distal end 56 with a single connection point. Each of the coil lines 30 is affixed (such as by soldering or any suitable method) to a corresponding proximal connection point 54A-D. The distal end 56 is affixed (such as by soldering or any suitable method) to a refrigerant return line (not illustrated) to return the refrigerant from the coil lines to the compressor. The vacuum line distributor cap 50 is typically constructed of aluminum or copper, or any other suitable material.

Refrigerant is pumped (via a pump, not illustrated) from a compressor (not illustrated) via a supply line not illustrated) into the proximal end 42 of the liquid line distributor cap 40. The refrigerant then flows from the liquid line distributor cap 40 via the distal connection points 44A-D into each of the coil lines 30. The refrigerant then flows from the coil lines 30 into the vacuum line distributor cap 50 and then back to the compressor via a return line (not illustrated).

Air to be conditioned is drawn into the cylindrical air handler 10 through the first end 14 and passes across the novel conical refrigerant coil 20. The conical refrigerant coil 20 is arranged such that the air to be conditioned flows from the wide end to the narrow end of the conical refrigerant coil 20.

As mentioned above, the conical refrigerant coil of embodiments of the invention may comprise more or fewer than the four coil lines illustrated in FIGS. 4-8. In FIG. 9, conical refrigerant coil 60 comprises six coil lines. The conical refrigerant coil 60 of FIG. 9 is constructed of three outer coil lines that spiral together, such that the loops of each coil line alternate, and three inner coil lines that spiral together, such that the loops of each coil line alternate.

Figure 15:
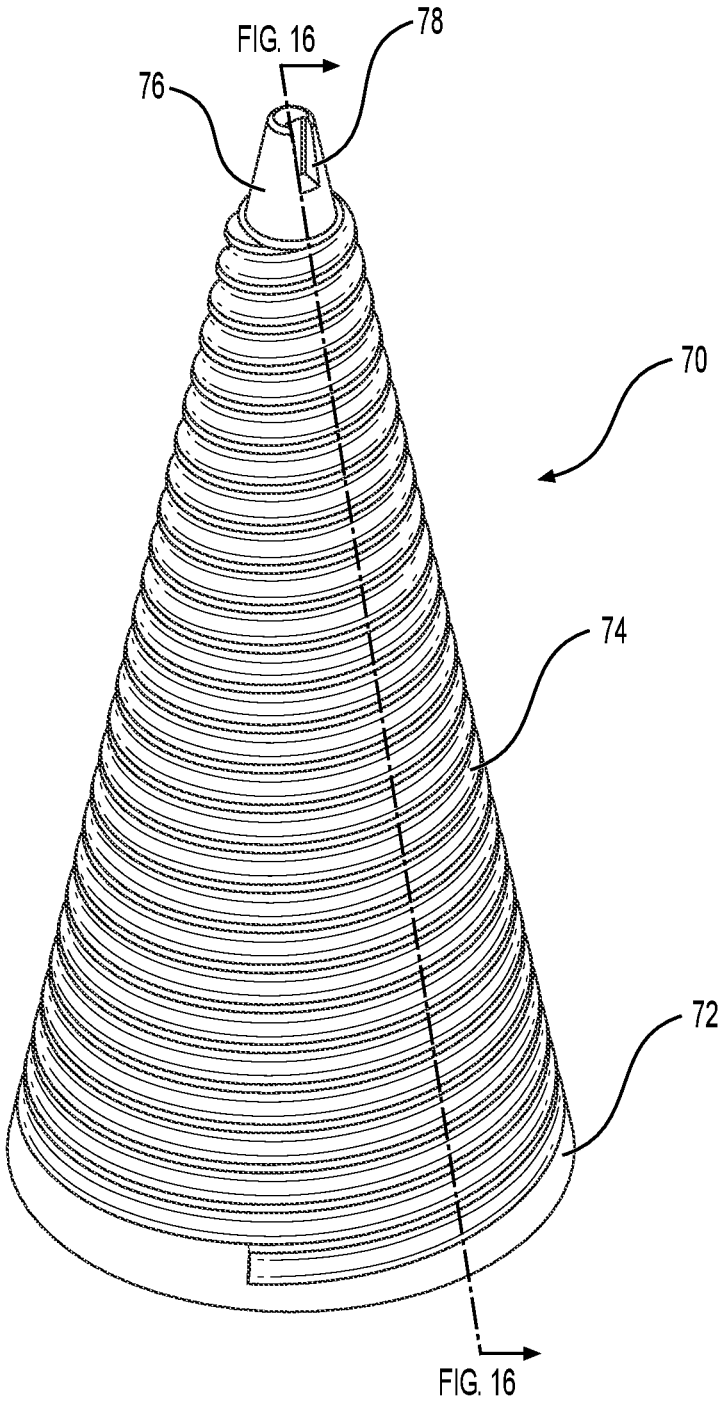
FIG. 15 is a perspective view of coil mold for bending a pipe into the desired shape for a conical refrigerant coil, in accordance with embodiments of the present invention.
Figure 16:
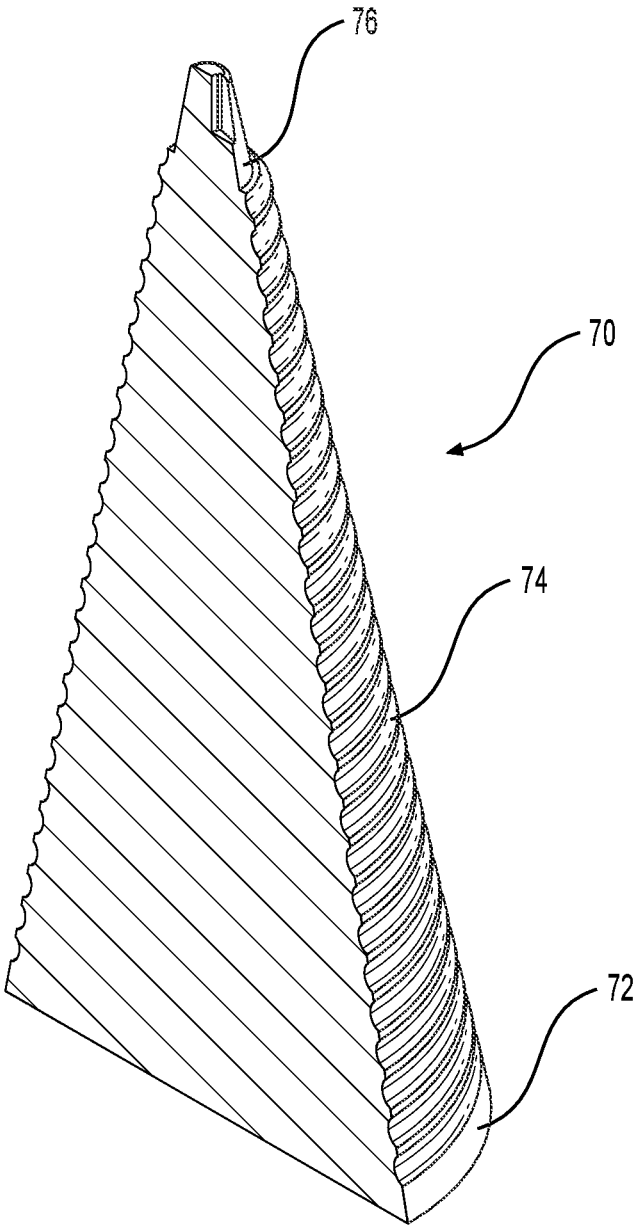
FIG. 16 is a sectional view of the coil mold of FIG. 15 along the section line shown in FIG. 15.

As described above, FIG. 10 illustrates a straight section of a coil line (prior to bending into a spiral cone) comprising a pipe 36 and a large number of cooling fins 38 attached to the outer surface thereof. Each coil line is manufactured by wrapping cooling fins around a straight pipe. The straight pipe is then bent in a conical spiral, such as by bending the pipe around a mold, such as the mold 70 illustrated in FIGS. 15 and 16. The mold 70 comprises a conical main body 72 with one or more spiral grooves 74 (two are shown) defined therein. The mold 70 may be constructed of any suitable material, such as any suitable plastic or metal.

Figure 17:
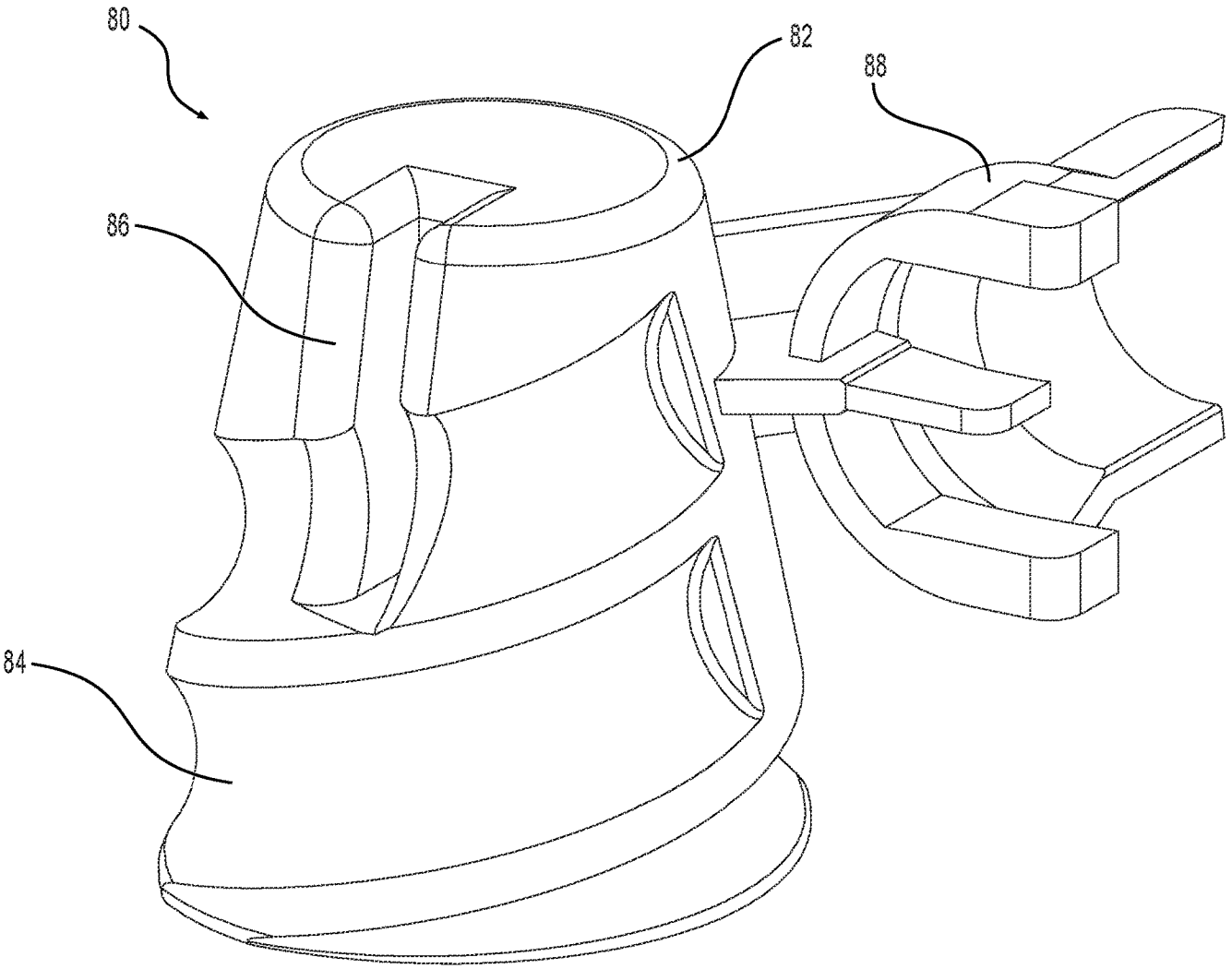
FIG. 17 is a perspective view of a coil end cap, in accordance with embodiments of the invention.

In the illustrated embodiment of the invention, the mold 70 is used in conjunction with a coil end cap 80 (shown in FIGS. 17 and 18) to bend the pipe around the mold 70. The mold 70 has a reduced size top portion 76 with a vertical keyway 78. The coil end cap 80 has a conical main body 82 with one or more spiral grooves 84 (two are shown) defined therein (the number of spiral grooves in the coil end cap 80 should match the number of spiral grooves in the mold 70). The main body 82 is hollow with an open bottom end to access a chamber 90. A vertical key 86 projects into the chamber 90. The coil end cap 80 may be placed on the top portion 76 of the mold 70 such that the top portion 76 enters the chamber 90 and the key 86 engages the keyway 78. The main body 82 has the same general conical shape (i.e., same angle) as the mold 70, such that the outer surface and the groove 84 of the coil end cap 80 align with the outer surface and the groove 74 of the mold 70.

Figure 18:
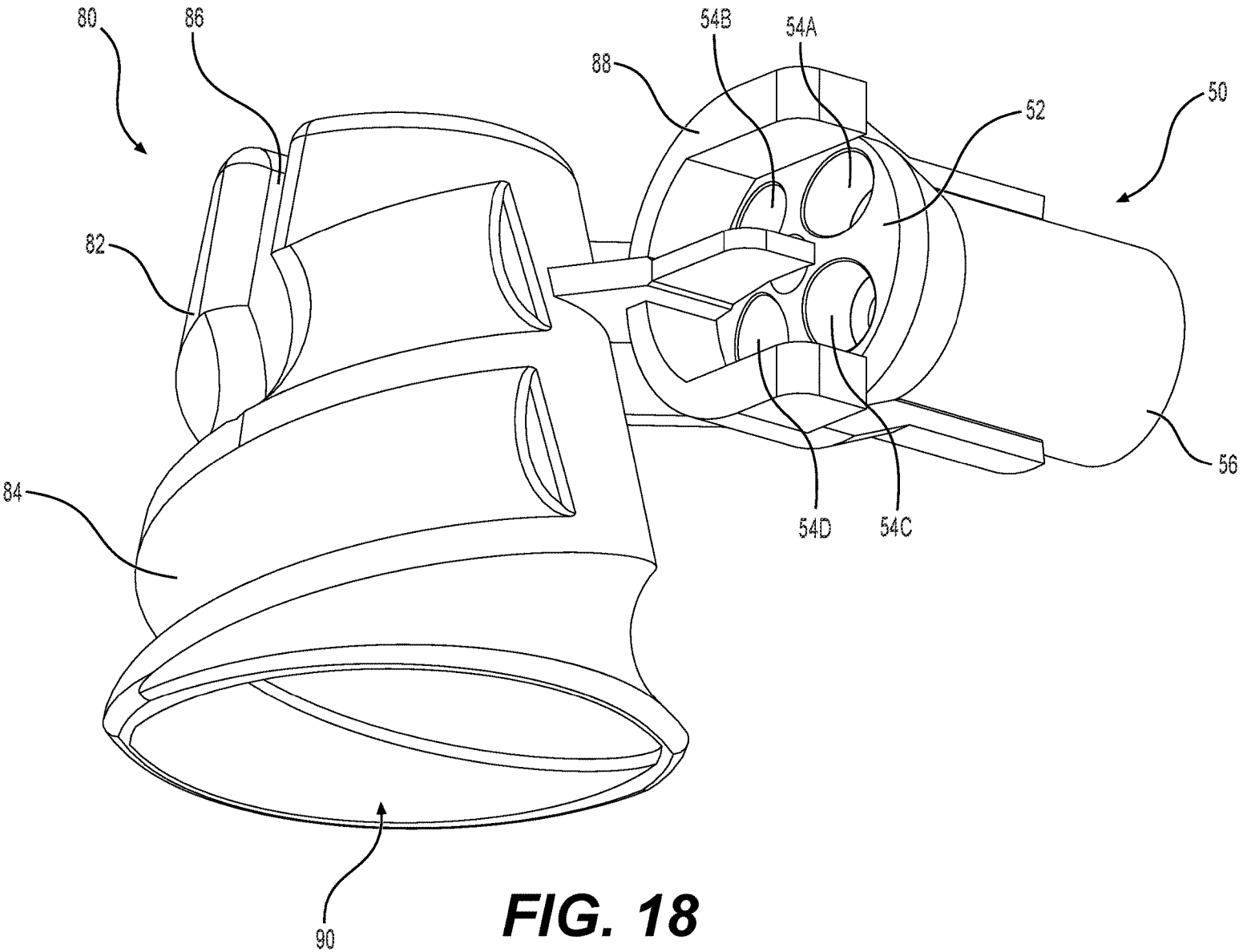
FIG. 18 is a bottom perspective view of the coil end cap of FIG. 17 engaging the suction line distributor cap of FIGS. 13 and 14.

The coil end cap 80 has a securing arm 88 to receive and retain the vacuum line distributor cap 50, as seen in FIG. 18. In the illustrated embodiment, the securing arm 88 retains the vacuum line distributor cap 50 using a press fit arrangement, however any suitable retention mechanism may be used. To prepare for bending the coil lines 30 (which are typically about 25-35 feet long) around the mold 70, the distal ends 34A-D of the coil lines 30 are affixed (such as by welding) to the proximal connection points 54A-D of the vacuum line distributor cap 50. (While the process for bending four coil lines around the mold is described herein, fewer or more coil lines may be bent around the mold at the same time.) The vacuum line distributor cap 50 is secured to the securing arm 88 of the coil end cap 80, and the coil end cap 80 is placed on top of the mold 70. The mold 70 may be secured to a machine (not illustrated) that rotates and raises the mold 70. The key 86 engaging the keyway 78 prevents the coil end cap 80 from spinning relative to the mold 70. As the mold 70 is rotated and raised, the coil lines are wrapped around the mold 70 such that the spiral grooves and conical shape of the mold impart the desired conical spiral to the coil lines.

After the coil lines are completely wrapped around the mold into the desired conical spiral, the spiral coil lines 30 and coil end cap 80 are removed from the mold 70. Advantageously, the coil end cap 80 may be left in place with the distal ends of the coil lines wrapped around the coil end cap 80 and the vacuum line distributor cap 50 engaged with the coil end cap 80. By leaving the coil end cap 80 in place at the top of the conical coil, air that would otherwise flow through a large opening at the top of the conical coil is at least partly blocked by the coil end cap 80 and therefore forced out through the coil lines and across the heat sink structures, thereby increasing heat transfer from the air to the coils.

The conical refrigerant coil of embodiments of the invention provides improvements over conventional refrigerant coils, such as conventional A-frame refrigerant coils. The conical shape of the refrigerant coil of embodiments of the invention (with air to be conditioned flowing into the wide end of the coil) provides an increased surface area to raw air (air that has not yet passed over/by/through the coils), thereby increasing heat transfer from the air to the coils. The gentle curve of the coil lines of the present invention provides a lower backpressure as compared to the U-shaped curves of a conventional A-frame refrigerant coil, thereby lowering the power consumption of the compressor and potentially extending the life of the compressor. The conical refrigerant coil of embodiments of the invention has much fewer solder joints than a conventional A-frame refrigerant coil (eight solder joints for four coil lines versus more than 100 solder joints for a conventional A-frame refrigerant coil), thereby greatly reducing the number of potential failure points.

The diameter of the air handler and the configuration of the conical refrigerant coil (e.g., number, length, and diameter of coil lines, height and diameter of conical coil, side slope angle) may vary depending on the specific cooling requirements (typically expressed in tons). It is expected that the air handler will be offered in fourteen, sixteen, and eighteen inch diameters, but other sizes are contemplated. To allow for insulation within the housing of the air handler, the conical refrigerant coil will have a slightly smaller diameter at its widest point. For example, a fourteen inch diameter air handler may have a conical refrigerant coil with a 12.75 inch outer diameter at its widest point.

The side slope angle of the conical refrigerant coil will vary depending on the desired air handler size and cooling capacity. It is anticipated that the side slope angle will typically be about nine to about fifteen degrees.

The overall height of the conical refrigerant coil will vary depending on the desired air handler size and cooling capacity. It is anticipated that a conical refrigerant coil with four coils will typically be about twenty-five inches tall.

In one specific embodiment of the invention, 1.5 tons of cooling capacity may be achieved using four coil lines arranged as illustrated in FIGS. 4-8, with each coil line being a 25 foot long ⅜ diameter pipe and with the overall conical refrigerant coil having a height of 25 inches, a diameter at the base of 12.75 inches, and a side slope angle of 11 degrees. In another specific embodiment of the invention, 5.0 tons of cooling capacity may be achieved using six coil lines arranged as illustrated in FIG. 9, with each coil line being a 30 foot long ⅜ diameter pipe and with the overall conical refrigerant coil having a height of 30.5 inches, a diameter at the base of 17.6 inches, and a side slope angle of 12 degrees.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below (if any) are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

That which is claimed:

1. A conical refrigerant coil comprising:

a plurality of pipes, each pipe arranged in a conical spiral and each pipe comprising a plurality of loops;

wherein at least some of the loops of each pipe of the plurality of pipes are arranged alternatingly along at least a portion of a length of the conical refrigerant coil, wherein each pipe of the plurality of pipes comprises an outer surface along a length thereof and a plurality of heat sink structures projecting in relation to the outer surface, the plurality of heat sink structures comprising a plurality of wires or a plurality of fins extending radially about the outer surface of each pipe of the plurality of pipes along a length of each pipe of the plurality of pipes.

2. The coil of claim 1, wherein the plurality of pipes is a first plurality of pipes; and wherein the conical refrigerant coil further comprises a second plurality of pipes, each of the second plurality of pipes arranged in a conical spiral and each of the second plurality of pipes comprising a plurality of loops;

wherein at least some of the loops of each pipe of the second plurality of pipes are arranged alternatingly along at least a portion of a length of the conical refrigerant coil; and wherein the second plurality of pipes is positioned at least partially within an interior space created by the first plurality of pipes.

3. The coil of claim 2, wherein each pipe of the second plurality of pipes comprises an outer surface along a length thereof and a plurality of heat sink structures projecting radially in relation to the outer surface of each pipe of the second plurality of pipes.

4. The coil of claim 3, wherein the plurality of heat sink structures projecting from each pipe of the second plurality of pipes comprises a plurality of wires or a plurality of fins extending radially about each pipe of the second plurality of pipes along a length of each pipe of the plurality of pipes.

5. The coil of claim 1, further comprising:

a supply junction comprising a proximal end adapted to be connected to a refrigerant supply line and a distal end having a plurality of connection points, wherein each connection point of the distal end of the supply junction is connected to a proximal end of a corresponding pipe; and a return junction comprising a proximal end having a plurality of connection points and a distal end adapted to be connected to a refrigerant return line, wherein each connection point of the proximal end of the return junction is connected to a distal end of a corresponding pipe;

wherein the supply junction is adapted to receive a refrigerant via the refrigerant supply line and distribute the refrigerant among the plurality of pipes.

6. An air handler comprising:

a cylindrical housing;

a conical refrigerant coil within the housing, the conical refrigerant coil comprising a plurality of pipes, each pipe arranged in a conical spiral and each pipe comprising a plurality of loops, wherein at least some of the loops of each pipe of the plurality of pipes are arranged alternatingly along at least a portion of a length of the conical refrigerant coil; and a fan within the housing adapted to blow or draw air across the conical refrigerant coil.

7. The air handler of claim 6, wherein each pipe of the plurality of pipes comprises an outer surface along a length thereof and a plurality of heat sink structures projecting radially in relation to the outer surface of each pipe of the plurality of pipes.

8. The air handler of claim 7, wherein the plurality of heat sink structures comprises a plurality of wires or a plurality of fins extending radially about each pipe of the second plurality of pipes along a length of each pipe of the plurality of pipes.

9. The air handler of claim 6, wherein the plurality of pipes is a first plurality of pipes; and wherein the conical refrigerant coil further comprises a second plurality of pipes, each of the second plurality of pipes arranged in a conical spiral and each of the second plurality of pipes comprising a plurality of loops;

wherein at least some of the loops of each pipe of the second plurality of pipes are arranged alternatingly along at least a portion of a length of the conical refrigerant coil; and wherein the second plurality of pipes is positioned at least partially within an interior space created by the first plurality of pipes.

10. The air handler of claim 9, wherein each pipe of the second plurality of pipes comprises an outer surface along a length thereof and a plurality of heat sink structures projecting radially in relation to the outer surface of each pipe of the second plurality of pipes.

11. The air handler of claim 10, wherein the plurality of heat sink structures projecting from each pipe of the second plurality of pipes comprises a plurality of wires or a plurality of fins extending radially about each pipe of the second plurality of pipes along a length of each pipe of the plurality of pipes.

12. The air handler of claim 6, further comprising:

a supply junction comprising a proximal end adapted to be connected to a refrigerant supply line and a distal end having a plurality of connection points, wherein each connection point of the distal end of the supply junction is connected to a proximal end of a corresponding pipe; and a return junction comprising a proximal end having a plurality of connection points and a distal end adapted to be connected to a refrigerant return line, wherein each connection point of the proximal end of the return junction is connected to a distal end of a corresponding pipe;

wherein the supply junction is adapted to receive a refrigerant via the refrigerant supply line and distribute the refrigerant among the plurality of pipes.

13. The air handler of claim 6, further comprising:

a plug positioned at a narrow end of the conical refrigerant coil to reduce or eliminate air flow through the narrow end of the conical refrigerant coil.

14. A conical refrigerant coil comprising:

a first pipe arranged in a conical spiral and comprising a plurality of loops; and a second pipe arranged in a conical spiral and comprising a plurality of loops;

wherein two or more of the loops of the first pipe are arranged alternatingly with two or more loops of the second pipe along at least a portion of a length of the conical refrigerant coil, wherein each pipe of the first and second pipes comprises an outer surface along a length thereof and a plurality of heat sink structures projecting in relation to the outer surface, the plurality of heat sink structures comprising a plurality of wires or a plurality of fins extending radially about the outer surface of each pipe of the first and second pipes along a length of each pipe of the plurality of pipes.

15. The coil of claim 14, further comprising a third pipe arranged in a conical spiral and comprising a plurality of loops; and a fourth pipe arranged in a conical spiral and comprising a plurality of loops;

wherein two or more of the loops of the third pipe are arranged alternatingly with two or more loops of the fourth pipe along at least a portion of a length of the conical refrigerant coil; and wherein the third and fourth pipes are positioned at least partially within an interior space created by the first and second pipes.

16. The coil of claim 15, wherein the third and fourth pipe each comprise an outer surface along a length thereof and a plurality of heat sink structures projecting radially in relation to the outer surface of each pipe of the third and fourth pipes.

17. The coil of claim 16, wherein the plurality of heat sink structures projecting from the third and fourth pipes comprises a plurality of wires or a plurality of fins extending radially about each pipe of the third and fourth pipes along a length of each pipe of the plurality of pipes.

18. The coil of claim 14, further comprising:

a supply junction comprising a proximal end adapted to be connected to a refrigerant supply line and a distal end having at least two connection points, wherein each connection point of the distal end of the supply junction is connected to a proximal end of a corresponding pipe; and a return junction comprising a proximal end having at least two connection points and a distal end adapted to be connected to a refrigerant return line, wherein each connection point of the proximal end of the return junction is connected to a distal end of a corresponding pipe;

wherein the supply junction is adapted to receive a refrigerant via the refrigerant supply line and distribute the refrigerant among the pipes.

* * * * *